United States Patent [19]

Brudny-Chelyadinov et al.

[11] Patent Number: 4,676,716

[45] Date of Patent: Jun. 30, 1987

[54] HYDRAULIC MULTISTAGE TURBINE OF TURBODRILL

[75] Inventors: Sergei J. Brudny-Chelyadinov, Ljubertsy-Moskovskaya; Vigdor S. Budyansky; Viktor A. Filimonov, both of Moscow, all of U.S.S.R.

[73] Assignee: Vsesojuzny Nauchno-Issle-Dovatelsky Institut Burovoi Tekhniki, Moscow, U.S.S.R.

[21] Appl. No.: 794,958

[22] Filed: Nov. 4, 1985

Related U.S. Application Data

[63] Continuation of Ser. No. 581,249, Feb. 17, 1984, abandoned.

[51] Int. Cl.[4] ..... F04D 29/32; F03B 13/02

[52] U.S. Cl. ..... 415/144; 415/199.5; 415/502; 415/503; 173/73; 173/78

[58] Field of Search ..... 415/144, 199.5, 502, 415/503, 115, 501; 175/107; 173/73, 75, 78

[56] References Cited

U.S. PATENT DOCUMENTS

| | | | |
|---|---|---|---|
| 2,269,235 | 1/1942 | Warren | 415/144 |
| 2,291,828 | 8/1942 | New | 415/144 |
| 2,744,721 | 5/1956 | Hatch | 415/502 |
| 3,176,957 | 4/1965 | Rice | 415/144 |
| 3,356,338 | 12/1967 | Ioannesian et al. | 415/144 |
| 3,882,946 | 5/1975 | Ioannesian et al. | 175/107 |
| 3,938,596 | 2/1976 | Ivanov et al. | 173/73 |
| 4,146,352 | 3/1979 | Yasugahira et al. | 415/144 |

FOREIGN PATENT DOCUMENTS

| | | | |
|---|---|---|---|
| 1132055 | 9/1982 | Canada . | |
| 1271127 | 7/1961 | France | 175/107 |

*Primary Examiner*—Robert E. Garrett
*Assistant Examiner*—Joseph M. Pitko
*Attorney, Agent, or Firm*—Burgess, Ryan & Wayne

[57] ABSTRACT

A hydraulic multistage turbine each stage of which comprises a stator and a rotor having rings with flow channels and hubs carrying the bladings. There are stages wherein the blades of the bladings are made with an angle of curvature of the camber line greater than an angle formed by the tangent to this line at the exit of the blading and the axis of drilling fluid flow. In a stage wherein the ring has such blades it is provided with by-pass channels arranged hydraulically parallel to the flow channel of the ring and communicating the space between this ring and an upstream ring with a space between this ring and a downstream ring for discharging part of the drilling fluid from the flow channel.

8 Claims, 8 Drawing Figures

HYDRAULIC MULTISTAGE TURBINE OF TURBODRILL

This application is a continuation of application Ser. No. 581,249, filed Feb. 17, 1984, now abandoned.

The present invention relates to downhole motors for driving rock destruction drilling tools and more particularly to turbodrill hydraulic multistage turbines using, for example, water, clay drilling mud, oil-base drilling mud as a drilling fluid.

A turbine of the invention is essentially a multitude of axially alternating stators and rotors secured respectively in the housing and on the shaft of a turbodrill. The stator and rotor arranged in succession in the direction of flow axis make up a turbine stage.

All stages of a multistage turbine have equal inside and outside diametrical dimensions and an axial dimension.

In each stage the stator and the rotor are provided with a ring and a spacing sleeve.

Any ring has a flow channel and a hub carrying a respective blading comprising a plurality of blades equally spaced in the flow channel, and a rim.

The spacing sleeves serve for securing respective rings in the housing and on the shaft of a turbodrill and for ensuring uniform alternation of the stator and rotor rings throughout the entire length of a multistage turbine.

All hydraulic turbines known at present time, including turbodrill multistage turbines, are made with the stator and rotor rings sealed along the clearances between the revolving and stationary parts of the turbine in order to provide a maximum possible prevention of leaks of the drilling fluid past the flow channel with the blading. To this end the clearances in hydraulic turbines, especially the radial clearances, are made as minimum as possible and the value thereof is governed by adaptability to assembly.

The known turbodrill turbines have a value of the radial clearance within the limits of 0.5 to 1 mm. The se turbines are characterized by an increased rotational speed of the shaft which has an adverse effect on serviceability of roller-cutter drilling bits.

Besides, due to commensurability of dimensions of the solid phase contained in the drilling fluid and the radial clearances, a substantial portion of the moment of force is lost in the known turbines because of friction in the fluid leading to rapid wear of turbines and impairing their energy characteristic.

Known in the prior art is a turbodrill multistage turbine (cf., for example, FRG Pat. No. 2,942,782), wherein in order to increase the torque and efficiency a hub of an upstream ring from a pair of adjacent rings partially overlaps the flow channel of a succeeding ring on the side of its radial clearance.

The given turbine has an increased rotational speed which prevents it from being effectively used for driving roller-cutting drilling bits.

In addition, from 5 to 40% of the torque (depending on the concentration of a solid phase) is lost in this turbine because of mechanical friction between the rotors and stators along the radial clearances.

It is an object of the present invention to provide such a turbodrill turbine the construction of which will ensure a reduced rotational speed for improving the operating conditions for roller-cutter drilling bits and also for minimizing the losses of the moment of force due to friction in the drilling fluid by providing special means to ensure communication between the space at the entry in the ring blading and at the exit therefrom.

The exact nature of the invention resides in that in a turbodrill multistage turbine each stage of which comprises a stator and a coaxially disposed rotor each of which has a spacing sleeve and a ring with a flow channel for passing the drilling fluid and a hub carrying a blading and a rim arranged in the flow channel, the blades of at least a number of the rings being made with an angle of the camber line curvature greater than an acute angle formed by the tangent to this line at the exit of the blading and the axis of drilling fluid flow, according to the invention in a stage comprising at least one blading with said curvature of the camber line, the ring with such blading is made with by-pass channels arranged hydraulically parallel to the flow channel of the ring and communicating the space between this ring and the upstream ring with the space between this ring and the succeeding downstream ring for discharging part of the drilling fluid from the flow channel.

The by-pass channels made hydraulically parallel to the flow channels accommodating the blades with said curvature of the camber line provide for automatic regulation of the drilling fluid flow rate depending on the mode of turbine operation. Due to an increase in hydraulic friction of the blading with said blades taking place in the period from the stalling mode to the no-load running condition as the turbine gains speed, the flow rate of the fluid delivered to the blading will continuously decrease by virtue of discharging part of the fluid in the by-pass channels, with the result that the turbine rotational speed is reduced.

It is most preferable to make the by-pass channels in the form of an annular space between the rotor spacing sleeve and the stator ring, the ratio of the radial dimension of the annular space to the axial dimension of the ring being preferably in the range of 0.2 to 1.0. The lower limit of said range equal to 0.2 is dictated, according to the experimental data, by the beginning of an intensive regulation ensuring a substantial decrease in the rotational speed. The upper limit equal to 1.0 is governed by overall actual diametrical dimensions of turbodrill turbines.

In this case in addition to a decrease in the turbine rotational speed, the losses of the moment of force caused by rotation in the drilling fluid containing a solid phase are reduced and radial wear of the turbine is practically eliminated.

For this reason it is preferable to make the by-pass channels in the form of an annular space between the stator spacing sleeve and the rotor ring, the ratio of the radial dimension of the annular space to the axial dimension of the ring being preferably selected from a range of 0.14 to 0.5. The lower limit equal to 0.14 is dictated by the dimension of the solid phase amounting to 1.5 mm which is most characteristic of drilling fluids. The upper limit equal to 0.5 is conditioned by the fact that its further increase and a respective reduction of the rotational speed due to regulation of the fluid flow rate fails to compensate for a rise of the rotational speed because of decrease in the mean diameter of the rotor flow channel.

In order to rationally utilize the overall diametrical dimensions of a turbine and also to intensify regulation of the flow rate, the by-pass channels may be advantageously made in the body of the stator and rotor hubs.

For preventing the fluid leaks past the flow channel at a stalling mode, it is expedient to have the generating line of the hub surface forming the flow channel of a ring disposed upstream from the ring with by-pass channels on the side of the by-pass channel at the exit, inclined from top to bottom relative to the flow axis. For the same reason, it is preferable that the hub of a ring disposed upstream from the ring with by-pass channels partially overlaps its flow channel on the side of the by-pass channel When the by-pass channel is made in the body of a hub then in order to prevent the fluid leaks past the flow channel at a stalling mode, it is desirable that the rim of a ring disposed upstream from the ring with the by-pass channels should partially overlap its flow channel on the side of the by-pass channel.

The invention will now be described in greater detail with reference to specific embodiments thereof, taken in conjunction with the accompanying drawings, wherein:

FIGS. 1*a* and 1*b* illustrate a general view of a turbodrill with a bit in the bore hole, comprising a multistage turbine, according to the invention;

Figure 1A:
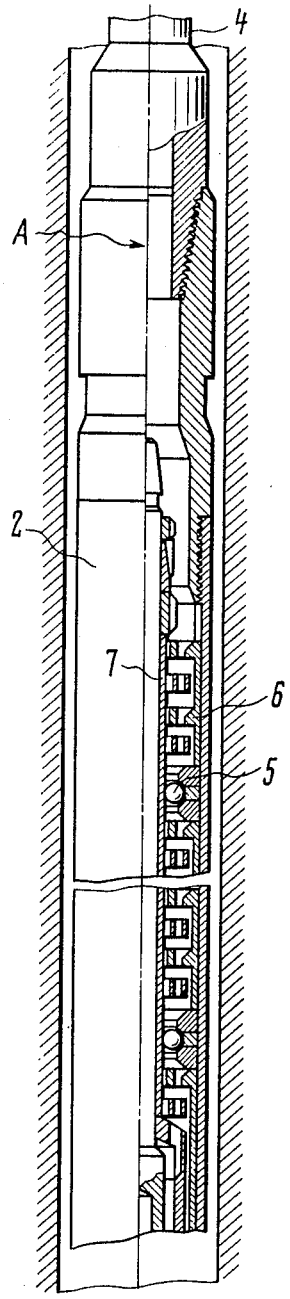
Figure 1B:
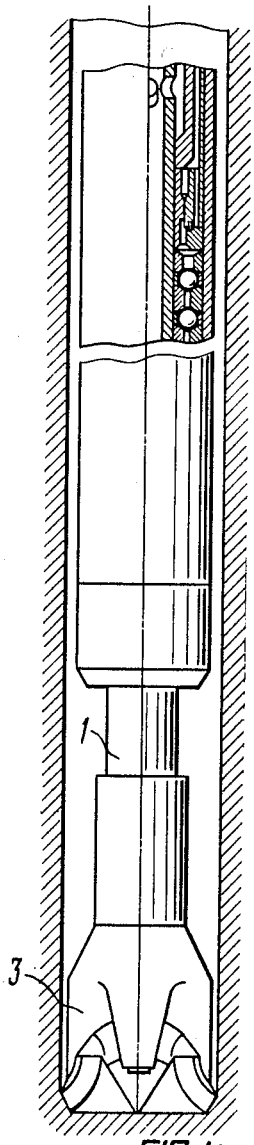
Figure 2:
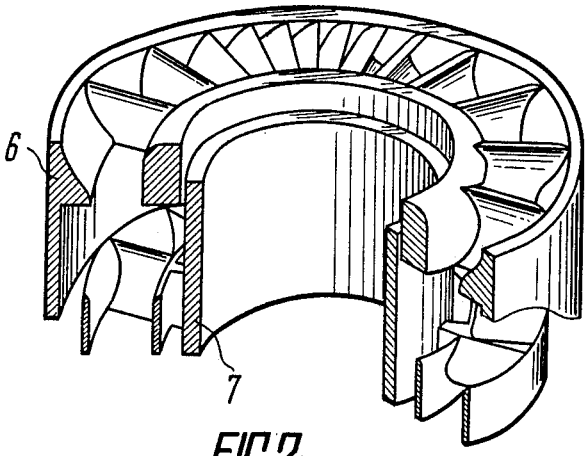
FIG. 2 is an exploded view of a turbine stage, according to the invention.

A hydraulic multistage turbine is a working member of a turbodrill (FIGS. 1*a* and 1*b*), wherein a rock destruction tool 3 is connected to a shaft 1 and a drill pipe 4 is connected to a housing 2. The shaft 1 is centered in the housing 2 by means of radial bearings 5 which ensures coaxial rotation of the shaft 1 relative to an axis A of the turbine. Each stage of the turbine comprises a stator 6 and a rotor 7 (FIG. 2).

In a turbodrill the system of the stators 6 (FIGS. 1*a* and 1*b*) is fixed against turning relative to the housing 2 and the system of the rotors 7 is fixed against turning relative to the shaft 1. In each stage the stator 6 (FIG. 3) and the rotor 7 are provided with respective rings 8 and 9, and also with respective spacing sleeves 10 and 11. The ring 8 of the stator 6 and the ring 9 of the rotor 7 are provided with respective flow channels 12, 13 and also with hubs 14, 15 carrying bladings 16, 17 with rims 18, 19 thereof.

A straight line S which is parallel to the axis A of rotation and passes in the interior of the flow channels 12, 13 may be called an axis of the flow. An arrow on the axis S of flow indicates the direction of drilling fluid movement.

Figure 5:
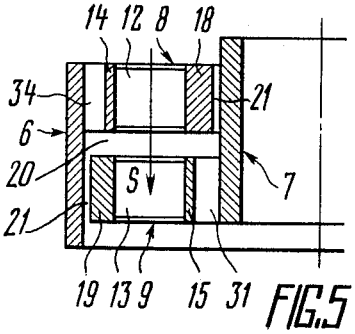
FIG. 5 shows an alternative embodiment of the turbine, according to the invention, with by-pass channels in the body of stator and rotor hubs.

From the two rings 8 and 9 (see, for example, FIG. 5) the ring 8 is an upstream one relative to the ring 9, while in relation to the ring 8 ring 9 is a downstream.

Figure 3:
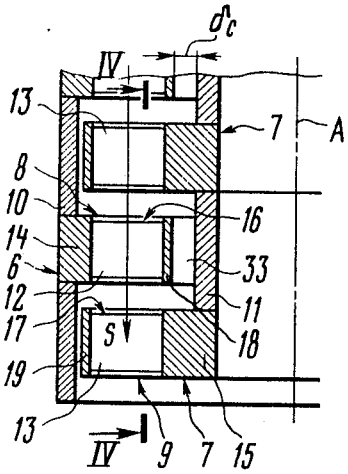
FIG. 3 illustrates an alternative embodiment of the turbine, according to the invention, with a by-pass channel in the form of an annular space between the rim of a stator and the spacing sleeve of a rotor.
Figure 4:
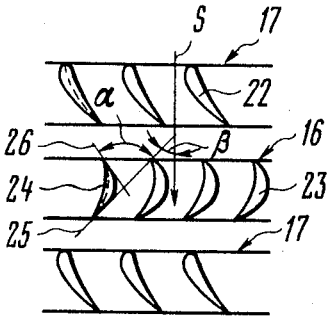
FIG. 4 is a cylindrical section taken on the line IV—IV of a turbine blading of FIG. 3 (developed on a plane for clarity)

During operation of the turbine the rotation of the rotors 7 relative to the stators 6 is ensured by the provision of axial and radial clearances 20, 21 respectively. The bladings 16, 17 of the stator 6 and the rotor 7 (FIG. 4) are essentially sets of blades 22, 23 equally spaced in the flow channels 12, 13 (FIG. 3).

Profile of the turbine blades 22, 23 (FIG. 4) is usually characterized by a camber line 24, tangents 25 and 26 to the camber line 24 at the exit and entry of the blading respectively, an angle $\alpha$ of curvature of the chamber line 24 and an angle $\beta$ between the tangent 25 and the axis S of flow.

Figure 6:
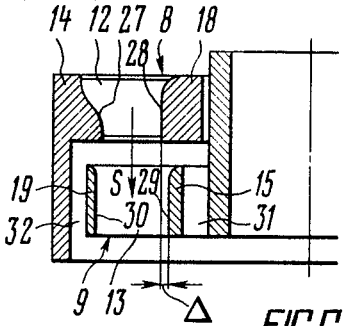
FIG. 6 illustrates an alternative embodiment of the turbine according to the invention, with the generating line of the hub surface forming the flow channel on the side of one by-pass channel disposed downstream from the rotor, inclined from top to bottom relative to the flow axis, and also with partial overlapping of the rotor flow channel by the stator rim on the side of another by-pass channel.

Embodiment of the flow channels 12, 13 (FIG. 6) is determined by the configuration of generating lines 27, 28, 29, 30 of surfaces of the hubs 14, 15 and the rims 18, 19 respectively, forming the flow channels 12, 13 (same referemce numbers denote identical elements).

It is to be understood that there may be various embodiments of the turbine. However, irrespective of a specific embodiment, all the turbines, according to the invention, are made such that in a stage comprising at least one blading 16 (FIGS. 3, 4) the blades 23 of which have the angle $\alpha$ of curvature of the camber line 24 greater than the acute angle $\beta$ formed by the tangent 25 to the camber line 24 at the exit of the blading 16 and the axis S of drilling fluid flow, the ring with such a blading is made with by-pass channels 33 arranged hydraulically parallel to the flow channel 12 of the ring 8 and communicating the space between the ring 8 and the upstream ring 9 with the space between the ring 8 and the downstream ring 9 for discharging part of the drilling fluid from the flow channel 12 of the ring 8. The blading 16 is characterized by a variable hydraulic friction which depends on the mode of turbine operation (rotational speed) and is lower at a stalling mode and rises as the turbine gains speed.

Figure 7:
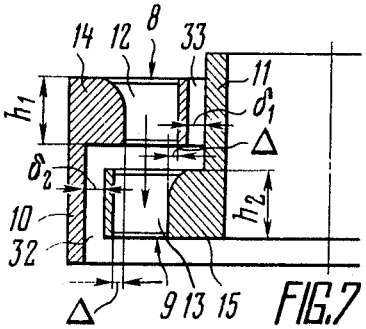
FIG. 7 illustrates an alternative embodiment of the turbine, according to the invention, with by-pass channels in the form of annular spaces between the rings of a stator and the spacing sleeve of a rotor, and the ring of a rotor and the spacing sleeve of a stator.

With the by-pass channels made in the form of annular spaces 32 and 33 (FIG. 7) an increase in effectiveness of the turbine operation is attained also due to a substantial decrease in losses of the moment of force caused by friction in the drilling fluid containing the solid phase and in wear of the turbine. In addition to the by-pass channels made in the form of the annular spaces 32 and 33, an embodiment of the turbine shown in FIG. 7 is also characterized by the provision of partial ovelappings $\Delta$ of the flow channel 13 on the side of the by-pass channel 32 by the hub 14 and also the flow channel 12 on the side of the by-pass channel 33 by the hub 15.

The experimental investigations have proved that at a ratio of a radial dimension $\delta_1$ of the annular space 33 between the spacing sleeve 11 of the rotor 7 and the ring 8 of the stator 6 to an axial dimension $h_1$ of the ring 8 being in the range of 0.2 to 1.0, the most favorable conditions are provided for regulation of the fluid flow rate in the stator 6 (FIG. 2). As to the rotor 7, such conditions are provided at a ratio of a radial dimension $\delta_2$ of the annular space 32 to an axial dimension $h_2$ of the ring 9 being in the range of 0.14 to 0.5.

Absolute values of $\delta_1$ and $\delta_2$ in real turbines made according to the invention amount respectively to 2.2–10 mm and 1.6–5 mm which are substantially greater than the values of the radial clearances in the known hydraulic turbines.

In order to rationally utilize the overall diametrical dimensions of a turbine which is especially essential for turbines of small diameters and also to intensify regulation, it is preferable to make the by-pass channels 34 and 31 (FIG. 5) in the body of the hub 14 of the stator 6 and the hub 15 of the rotor 7.

It is desirable that a generating line, for example 27 (FIG. 6), of the surface of the hub 14 forming the flow channel 12 of the ring 8 arranged upstream from the ring 9 with the by-pass channels 31 and 32 be inclined from top to bottom on the side of the by-pass channel 32 at the exit in relation to the axis S of flow. The flow channels 12, 13 of the rings 8, 9 made with such an inclination of the generating lines 27, 28, 29, 30 of the surface minimizes the leaks of the drilling fluid past the flow channels 13, 12 at a stalling mode determining the load pick-up characteristics of the turbine.

For the same reason, it is preferable that the hub 14 and/or 15 (FIGS. 6, 7) and the ring 18, 19 of the ring 8, 9 arranged upstream from the ring 9, 8 with by-pass channels 32, 33, 31, 34 respectively should partially overlap the flow channel 13, 21 on the side of the by-pass channels 32, 33, 31, 34 respectively.

A hydraulic multistage turbine of the invention operates in the following way.

From the surface, the mud pumps deliver the drilling fluid through the drill pipes 4 (FIGS. 1*a* and 1*b*) to the turbodrill. At a stalling mode the drilling fluid in the amount delivered by the pump from the surface passes out of the flow channel 13 of the rotor 7 (FIG. 3) with a preset deviation of the flow acquired due to interacting with the blading 17. Further the fluid passes in the flow channel 12 of the stator 6. As at this mode of operation the hydraulic friction of the blading 16 is at a minimum the drilling fluid enters in the full volume the flow channel 12 of the stator 6, wherein it acquires a respective deviation. Interaction of the drilling fluid with the bladings 17 and 16 in the full volume results in providing a maximum moment of force of the turbine.

As the turbine gains speed the hydraulic friction of the blading 16 increases due to which part of the drilling fluid (up to 30% at a no-load running condition) leaving the flow channel 13 goes in the by-pass channel 33 past the blading 16. The remaining part of the drilling fluid which passed through the blading 16 has a lower speed which provides a respective decrease in the rotational speed of the turbine. Thus the flow rate of the drilling fluid passing through the bladings is regulated inside the turbine proper which brings about the required reduction in the rotational speed, with the moment of force being retained.

Due to reduction in the rotational speed (up to 140–200 rpm in an optimal alternative embodiment), the use of the turbine of the invention makes it possible to improve durability of the bits by 1.5–4.0 times and consequently to increase the footage per bit by 1.3–3.0 times when compared with the known turbines. Greater figures are provided by the use of drilling bits with oil-fitted sealed bearings.

In an alternative embodiment of the turbine shown in FIG. 7, there is also provided a substantial decrease in the unfavorable losses of the moment of force caused by friction of the rotor 7 in the drilling fluid containing the solid phase, with the result that durability of the turbine is upgraded.

What is claimed is:

1. In a turbodrill provided with a rock destruction tool for drilling wells, a hydraulic turbine for driving said rock destruction tool under the action of a drilling fluid, comprising:

a plurality of identical stages each of which is formed by one stator and one rotor;

said stator of one stage;

a spacing sleeve of said stator;

a ring of said stator incorporating:

a hub;

a blading formed by a multitude of blades equally spaced on the inside of said hub of the stator ring;

a rim secured to said blades at the tips thereof away from said hub, and a flow channel for passing the drilling fluid arranged between said hub and said rim, and accommodating said blading;

blades of said blading which, at least in a number of said stator rings from said plurality of stages, are made with an angle of curvature of the camber line being greater than an acute angle formed by the tangent to this line at the exit of the blading and the axis of drilling fluid flow;

said rotor of one stage arranged coaxially with said stator;

a spacing sleeve of said rotor;

a ring of said rotor incorporating:

a hub;

a blading formed by a multitude of blades equally spaced along the periphery of said hub of the rotor ring;

a rim encompassing said blades at the tips thereof away from said hub, and a flow channel for passing the drilling fluid arranged between said hub and said rim, and accommodating said blading;

blades of said blading of the rotor ring which, at least in a number of said rotor rings from said plurality of the stages, are made with an angle of curvature of the camber line being greater than an acute angle formed by the tangent to this line at the exit of the blading and the axis of drilling fluid flow;

by-pass channels made at least in one of said rings of the stator or rotor from said plurality of the stages having said blades of the blading with the above-mentioned curvature of the camber line, said by-pass channnels being arranged hydraulically parallel to said flow channel of the ring and serving to communicate a space between this ring and an upstream ring with a space between this ring and a downstream for discharging part of the drilling fluid from said flow channel of the ring said by-pass channels in the stator having a radial dimension exceeding 2.2 mm, and in the rotor 1.6 mm.

2. A hydraulic turbine of a turbodrill as claimed in claim 1 wherein said by-pass channels are made in the form of an annular space between said spacing sleeve of the rotor and said ring of the stator, the radial dimension of said space being of a value lying in the range of from 2.2 to 10 mm.

3. A hydraulic turbine of a turbodrill as claimed in claim 2 wherein said by-pass channels are made in the form of an annular space between said spacing sleeve of the stator and said ring of the rotor, the radial dimension of said space being of a value lying in the range of from 1.6 to 5 mm.

4. A hydraulic turbine of a turbodrill as claimed in claim 3 wherein said by-pass channels are made in the body of said hub of the rotor.

5. A hydraulic turbine of a turbodrill as claimed in claim 2 wherein said by-pass channels are made in the body of said hub of the stator.

6. A hydraulic turbine of a turbodrill as claimed in claim 1 wherein the generating line of a surface forming said flow channel of the ring disposed upstream from the ring with said by-pass channels is inclined, on the side of said by-pass channel at the exit, from top to bottom relative to the flow axis.

7. A hydraulic turbine of a turbodrill as claimed in claim 1 wherein said hub of the ring disposed upstream from the ring with said by-pass channels partially overlaps its flow channel on the side of said by-pass channel.

8. A hydraulic turbine of a turbodrill as claimed in claim 1 wherein said rim of the ring disposed upstream from the ring with said by-pass channels partially overlaps its flow channel on the side of said by-pass channel.

* * * * *